US006039117A

United States Patent [19]

Mueller

[11] Patent Number: 6,039,117

[45] Date of Patent: Mar. 21, 2000

[54] DOWNHOLE WASH TOOL

[75] Inventor: Manfred W. Mueller, Celle, Germany

[73] Assignee: Mobil Oil Corporation, Fairfax, Va.

[21] Appl. No.: 08/873,361

[22] Filed: Jun. 11, 1997

[51] Int. Cl.[7] ..... E21B 37/00

[52] U.S. Cl. ..... 166/312; 166/320; 166/321; 166/334.4

[58] Field of Search ..... 166/222, 320, 166/321, 332.1, 312, 334.4

[56] References Cited

U.S. PATENT DOCUMENTS

| | | | |
|---|---|---|---|
| 1,379,815 | 5/1921 | Hall . | |
| 2,120,988 | 6/1938 | Park . | |
| 2,186,309 | 1/1940 | Travis . | |
| 2,290,141 | 7/1942 | Burt . | |
| 4,037,661 | 7/1977 | Ford . | |
| 4,393,927 | 7/1983 | Singer | 166/105 |
| 4,411,315 | 10/1983 | Baker et al. | 166/334.4 X |
| 4,441,557 | 4/1984 | Zublin | 166/312 |
| 4,625,799 | 12/1986 | McCormick et al. | 166/223 |
| 4,763,728 | 8/1988 | Lacey . | |
| 4,909,325 | 3/1990 | Hopmann . | |
| 5,337,819 | 8/1994 | Tailby | 166/317 X |

*Primary Examiner*—Roger Schoeppel
*Attorney, Agent, or Firm*—Malcolm D. Keen

[57] ABSTRACT

A downhole wash tool for carrying out cleaning operations in a borehole. The tool has a housing on which a plurality of flow-blocking, diverters (e.g. steel) are mounted. The diverters move between a retracted position and an extended position wherein the diverters effectively block flow around the tool. A retainer normally maintains the diverters in their retracted position when in a first position and releases the diverters when in a second position. A spring normally biases the retainer towards its first position. The retainer is hydraulically-actuated through the housing to move it towards its second position. When the cleaning operation is completed, pressure in the workstring is relaxed whereupon the spring moves the retainer back to its first position to retract the diverters.

13 Claims, 2 Drawing Sheets

FIG. 1
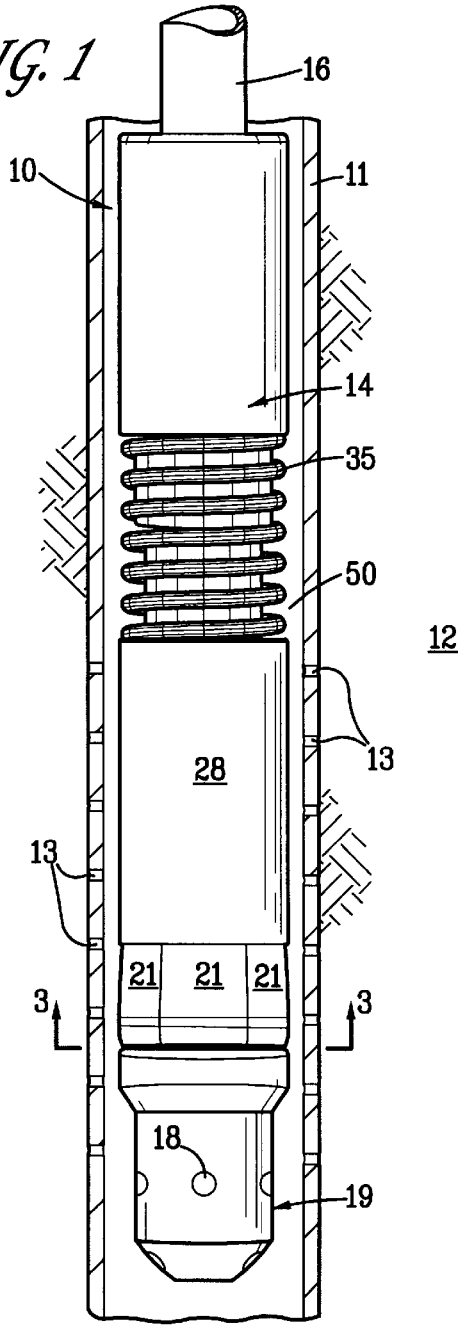
FIG. 2
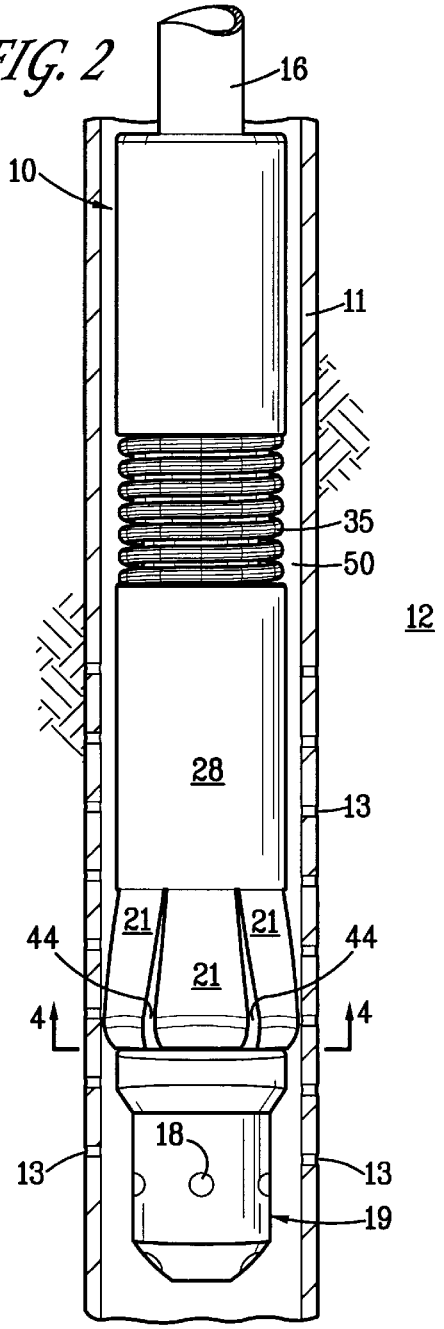
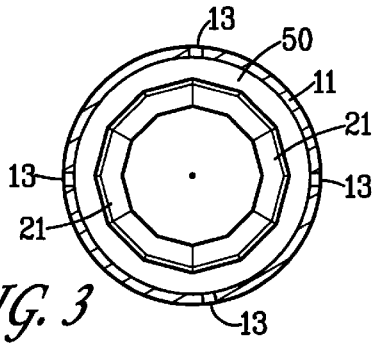
FIG. 3
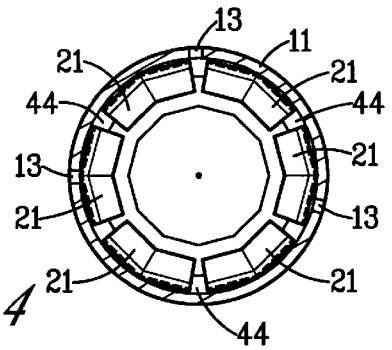
FIG. 4

DOWNHOLE WASH TOOL

1. TECHNICAL FIELD

The present invention relates to a downhole wash tool and in one of its aspects relates to a downhole wash tool for cleaning openings in a well tubular and/or the formation therebehind wherein said tool has flow-blocking diverters thereon which are normally retracted to allow the tool to be run in and out of the borehole but expand outwardly during a wash operation to substantially block upward flow of the wash fluid around the tool when the tool is in an operable position within a wellbore.

2. BACKGROUND OF THE INVENTION

In producing hydrocarbons or the like from subterranean formations, it is now common to use boreholes or laterals which extend horizontally into the producing formation. Such horizontal boreholes are often completed by "casing" the borehole with a liner having pre-formed openings therein (e.g. perforations, slots, etc.). This uncemented liner serves (a) to stabilize the formation and prevent caving of the borehole during production and (b) to provide access into the borehole for a variety of downhole, work-over tools which may be needed during the production life of the well.

Frequently, in completions of this type, it is necessary to "clean" the openings in the liner and/or the formation behind the liner to improve the production of fluids from the formation. This cleaning operation is routinely carried out by injecting a "cleaning fluid", e.g. water, gas, etc., through the openings in the liner and into the formation behind the liner. As will be recognized in the art, a wide variety of downhole tools, sometimes called "wash tools" have been proposed for carrying out this type of operation.

For example, in one group of wash tools, a nozzle or the like is attached to the bottom of a workstring on which the nozzle is lowered down the well and into the liner. Fluid, e.g. water, gas, etc. is then flowed down the workstring and out the nozzle to thereby "wash" the openings in the liner and/or flush the accumulated material in the formation behind the liner away from the openings. The nozzle may be either fixed or may rotate as the wash fluid passes therethrough e.g. see U.S. Pat. Nos. 2,120,988; 2,186,309; 4,037,661; 4,909,325; and 5,533,571.

To provide sufficient clearance for tools of this type to be run into and out of the well, the outer diameter of the tool is normally substantially less than the smallest inside diameter expected to be encountered within the well; e.g. landing nipples, etc. This requirement can result in a relatively large annulus between the tool and the inner wall of the liner when the tool is in an operable position within the liner. Accordingly, when fluid flows out the nozzle during a cleaning operation, a substantial portion of that fluid will not achieve its objective, i.e. clean the openings and/or formation, but instead will by-pass the tool and flow upward through this large annulus back to the surface. This loss of cleaning fluid obviously adversely affects the efficiency of over-all operation.

To reduce the amount of returned fluid during a cleaning operation, other wash tools have been proposed which include some type of sealing means designed to block upward fluid flow between the tool and the liner. In those tools where the seals are expandable to block flow, e.g. see U.S. Pat. No. 2,290,141, the tool is complicated and requires a certain amount of sophistication for its operation. In tools having fixed seals thereon, e.g. see U.S. Pat. Nos. 1,379,815 and 4,763,728, their outer diameters are such that there is little clearance, if any, between the tool and the borehole which makes it difficult to run such tools into and out of a borehole, especially a horizontal borehole.

SUMMARY OF THE INVENTION

The present invention provides a downhole wash tool adapted to be fluidly connected to a workstring and lowered into a well tubular in a borehole. While the tool can be used in vertical wells, it is especially useful in inclined and horizontal boreholes. Basically, the tool is comprised of a housing which has a fluid nozzle at its lower end. Cleaning fluid, e.g. water, gas, etc.) is passed down the workstring and out the nozzle to wash openings (e.g. perforations, slots, etc.) in the well tubular and/or clean the formation therebehind as will be understood in the art.

The housing has a plurality of flow-blocking, diverter means thereon which are movable between (a) a retracted position against said housing and (b) an extended position wherein said diverters contact the well tubular when the tool is in an operable position within the tubular. A retainer is slidably mounted on the housing which, when in a first position, normally maintains the diverters in their retracted position to thereby provide sufficient clearance for the tool to be easily positioned into and removed from the tubular. A spring or the like normally biases the retainer towards its first position.

The retainer is hydraulically-actuated by increasing the pressure of the cleaning fluid flowing through the housing to thereby move the retainer towards a second position where the diverters become disengaged from the retainer and extend outwardly into contact with the tubular wall to thereby effectively block upward flow around the tool. When the cleaning operation is completed, pressure in the workstring is relaxed whereupon the bias of the spring agains moves the retainer toward its first position to retract the diverters. This then allows the tool to be easily removed from the borehole.

More specifically, the wash tool of the present invention is comprised of a housing having a longitudinal bore therethrough which, in turn, is adapted to be fluidly connected to the lower end of the workstring, e.g. coiled tubing and lowered into a well tubular (e.g. pre-perforated liner). The housing has a nozzle at its lower end which is in fluid communication with the bore of the housing. A collet is fixed on the housing and has a plurality of diverters (e.g. steel) thereon which move between a retracted position against said housing and an extended position where the diverters contact the inner wall of a well tubular (i.e. pre-perforated liner) to effectively block flow around the tool.

A retainer, e.g. sleeve, is slidably mounted on the housing and is movable between (a) a first position wherein the sleeve engages the diverters to maintain them in a retracted position and (b) a second position wherein the diverters are disengaged from the sleeve so that they are free to move outward to their extended position. A spring on the housing acts against the sleeve to bias it towards its first position thereby normally maintaining the diverters in their retracted position as the tool is run into and out of the well.

The sleeve has a piston thereon which, when actuated by fluid through ports in the housing, moves the sleeve against the bias of the springs towards its second position to release the diverters for movement. When the operation is complete, the pressure on the fluid within the housing is relaxed to allow the spring to return the sleeve to its first position to thereby retract the diverters back in towards the housing.

By being able to extend and retract the diverters, the tool is easily positioned in and removed from a borehole but at the same time is capable of substantially reducing the unwanted flow of cleaning fluid past the tool during a cleaning operation. By blocking this flow, more of the cleaning fluid is directed through the openings in the liner and less is returned to the surface. This allows smaller volumes of cleaning fluid to be pumped which, in turn, results in substantially lower costs for a typical cleaning operation. That is, since shorter pumping times are required and less fluid and related equipment are needed, lower costs are incurred in handling and disposing of the smaller, returned volumes of cleaning fluid.

BRIEF DESCRIPTION OF THE DRAWINGS

The actual construction, operation, and apparent advantages of the present invention will be better understood by referring to the drawings, not necessarily to scale, in which like numerals identify like parts and in which:

FIG. 1 is an elevational view, partly in section, of a wash tool in accordance with the present invention when the tool is in a retracted position within a borehole;

FIG. 2 is an elevational view, partly in section, of the tool of FIG. 1 when the tool is in an expanded position;

FIG. 3 is a cross-sectional view taken along line 3—3 of FIG. 1; and FIG. 4 is a cross-sectional view taken along line 4—4 of FIG. 2;

BEST KNOWN MODE FOR CARRYING OUT THE INVENTION

Referring more particularly to the drawings, FIG. 1 illustrates the downhole wash tool 10 of the present invention as it appears in a retracted position within a liner 11 which, in turn, is positioned within a borehole which has been drilled in formation 12. While the borehole may appear vertical in the FIGS., it should be recognized that the present tool is especially useful in inclined or horizontally-drilled wells as well as in vertical wells. Further, while the present invention is described in relation to a liner which is normally not cemented in a borehole, tool 10 can be used equally as well to inject fluid through openings in other well tubulars, e.g. perforations in cemented casing, etc.

Figure 5:
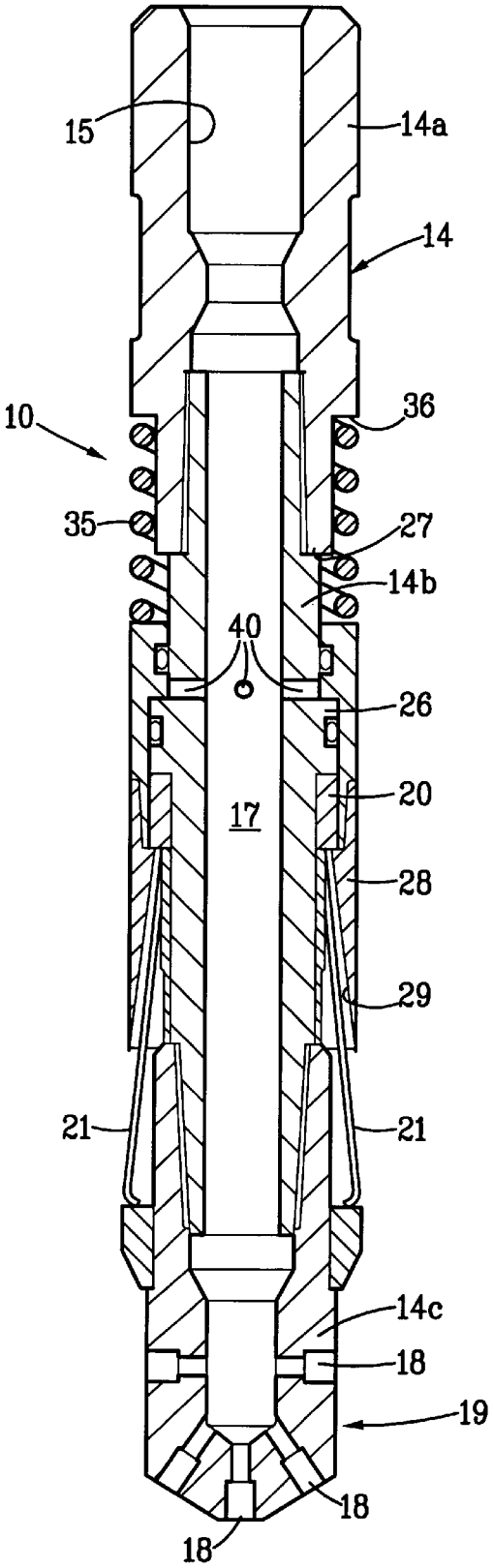
FIG. 5 is a sectional view of the tool of FIG. 1.
Figure 6:
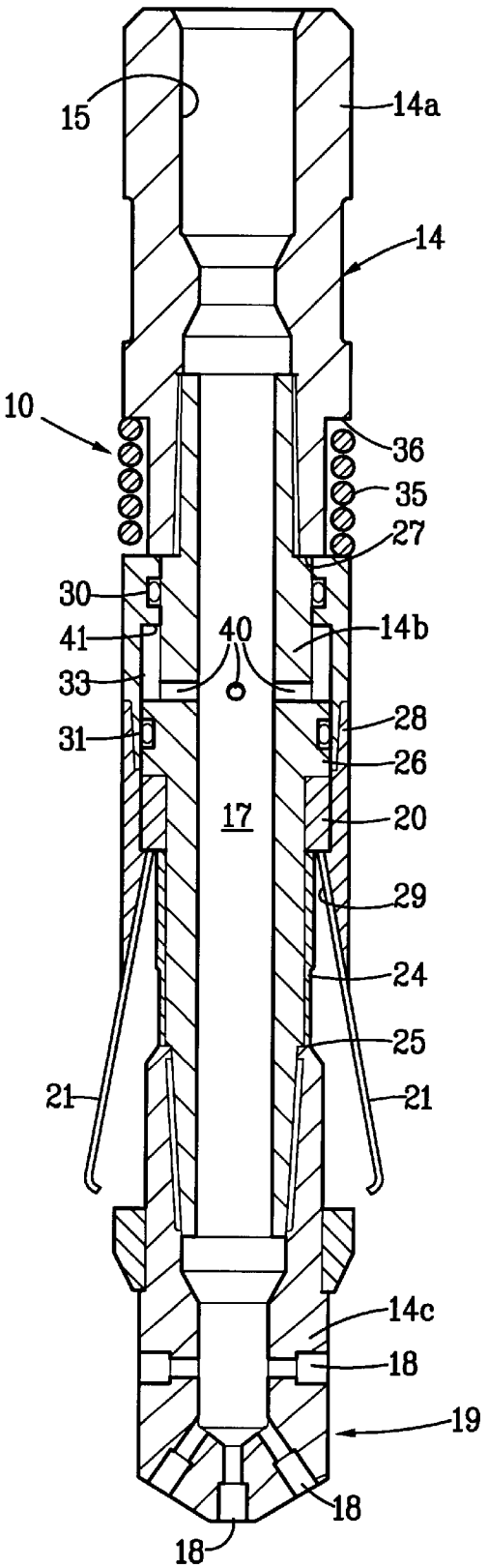
FIG. 6 is a sectional view of the tool of FIG. 2.

Downhole wash tool 10 is comprised of a housing 14 which, as best seen in FIGS. 5 and 6, is preferably constructed of three elements 14*a*, 14*b*, 14*c* which, in turn, are then joined together by any appropriate means (e.g. threads, not shown). The upper housing element 14*a* includes a connector 15 at its upper end which, in turn, is adapted to be coupled (e.g. threaded) onto the lower end of a workstring 16 (e.g. coiled tubing, FIG. 1). When assembled, housing 14 has a contiguous, longitudinal bore 17 therethrough which is in fluid communication with workstring 16.

Lower housing element 14*c* has a plurality of openings 18 therethrough which form a nozzle 19 on the lower end of element 14*c*. Collet or cage 20 is mounted onto the outer surface of center element 14*c* and includes a plurality (e,g, six) of fluid-blockinq members or diverters 21. Preferably, diverters 21 are made of high-quality steel wherein each diverter, in normal state, is in its expanded position (FIGS. 2 and 6) but can be easily retracted against its inherent resiliency to its retracted position (FIGS. 1 and 5), as will be explained below.

Although not shown, it should be recognized that diverters 21 could be made of other materials, e.g. high-strength plastics or the like, and could be hinged on cage 20 so that they would swing outwardly when pressure from upflowing fluid is applied to their respective lower surfaces. Collet 20 can be fixed onto housing 14 by any appropriate means. For example, as shown (FIGS. 5 and 6), a spacer 24 or the like is used to fix collet 20 between shoulder 25 on lower element 14*c* and flange 26 on center element 14*b*.

A retainer, i.e. sleeve 28, is slidably positioned on center element 14*c* and is movable longitudinally between shoulder 27 on upper element 14*a* and flange 26. Sleeve 28 has a inner, tapered surface 29 which is adapted to engage diverters 21 when sleeve 28 is moved towards a first or downward position (FIGS. 1 and 5). Appropriate seal means 30, 31 (e.g. O-rings) are mounted on sleeve 28 and flange 26, respectively to form a chamber 33 (FIG. 6) therebetween. A bias means 35 (e.g. coil spring) is positioned on housing 14 between shoulder 36 on upper element 14*a* and sleeve 28 to normally bias sleeve 28 to its downward or first position. Spring 35 is designed to provide sufficient bias to hold sleeve 28 in its first position during normal circulation of fluid through tool 10.

In operation, tool 10 is assembled wherein spring 35 forces sleeve 28 downward to compress diverters inward and hold them in their retracted position against housing 14 (FIGS. 1, 3, and 5). This allows tool 10 sufficient clearance so that it can be easily lowered through a wellbore and into liner 11. Once in an operable position, fluid is flowed down workstring 16 and the pressure is increased whereby the fluid will now flow out ports 40 in center element 14*b* and into chamber 33. This fluid acts on piston 41 on sleeve 28 to thereby force sleeve 28 upward against the bias of spring 35. As sleeve 28 moves upward towards a released or second position, it disengages from diverters 21 which, in turn, are now free to "spring" outward into contact with the inner wall of liner 11. In modifications where the diverters 21 might be hinged, the pressure of the fluid flowing upward in annulus 50 will act on the lower surfaces of the diverters to force the diverters outward and hold them in their extended or expanded position until the pressure is relaxed.

Fluid also flows out openings 18 in nozzle 19 and is forced through openings 13 in liner 11 to "wash" same and to clean the formation 14 therebehind, as will be understood in the art. With diverters 21 extended as shown in FIGS. 2, 4, and 6, any substantial upward flow of fluid through annulus 50 is effectively blocked thereby allowing substantially all of the cleaning fluid to flow through openings 13 to accomplish its objective. Further, tool 10 can be raised or lowered even while diverters 21 are extended to wash all of the openings 13 since the extended diverters will not lock tool 10 within liner 11.

It should be noted that slight spaces or gaps 44 (FIGS. 2 and 4) may exist between adjacent diverters 21 but these small spaces do not significantly affect the blocking efficiency of the upward flow around the tool. Of course, adjacent diverters 21 can be designed to overlap each other (not shown) when in their retracted position, if desired, to further reduce any by-pass of fluid around tool 10.

When the washing operation is completed, the pump pressure is relaxed whereby the bias of spring 35 overcomes the pressure in chamber 33 whereupon sleeve 28 is again moved downward to engage and retract diverters 21. With tool 10 in its retracted position, there is again sufficient clearance so that it can easily be withdrawn to the surface.

While the actual dimensions of a particular tool 10 will depend on the borehole in which it is to be used, the following example sets forth the dimensions of an actual tool 10 which has been used in a particular field application:

A horizontal borehole having a diameter of 14.6 cm (cross-sectional area of 167.3 $cm^2$) was drilled and cased with a pre-perforated liner having a drift diameter of 9.74 cm (area of 74.5 $cm^2$). The smallest obstruction (i.e. landing nipple) in the liner had an inner diameter of 8.28 cm, this being the approximate, maximum diameter of any well tool which could be run in the liner. A tool 10, in accordance with the present invention, was assembled which had an outer diameter of 8.12 cm (area of 51.8 $cm^2$) when in its retracted position. The diameter of the tool was 9.65 cm when the diverters 21 were extended. This provided an effective cross-sectional area of the extended tool of 70.1 $cm^2$ (i.e. total area of 73.1 $cm^2$ minus 3.0 $cm^2$ which was the area of gaps or spaces 44).

When the tool was in its retracted position within the liner, the area of annulus 50 was 22.7 $cm^2$; i.e. the area of liner 11 (74.5 $cm^2$) minus the area of retracted tool (51.8 $cm^2$). With diverters 21 extended, the area of annulus 50 was reduced to 4.4 $cm^2$ (area of annulus=74.5 $cm^2$ minus area of extended tool=70.1 $cm^2$). The efficiency of the cleaning operation could then be defined as being inversely proportional to the remaining area of cross-sectional area of annulus 50; i.e. (a) Without tool 10: 51.8 $cm^2$/74.5 $cm^2$=69.5% efficiency; (b) With tool 10: 70.1 $cm^2$/74.5 $cm^2$=94.1% efficiency.

What is claimed is:

1. A downhole wash tool adapted to be lowered into a well tubular, said tool comprising:

a housing adapted to be fluidly connected at a first end to a workstring;

a nozzle at a second end of said housing;

diverter means on said housing movable between a retracted position against said housing and an extended position wherein said diverter means will contact said well tubular when said tool is in an operable position within said tubular;

a retainer for normally maintaining said diverter means in said retracted position against said housing when said retainer is in a first position; and means for moving said retainer towards a second position whereby said diverter means are moved to said extended position.

2. The downhole wash tool of claim 1 wherein said retainer comprises:

a sleeve slidably mounted on said housing and being movable thereon between a first position and a second position, said sleeve being adapted to engage and retain said diverter means in said retracted position against said housing when said sleeve is in said first position and to disengage said diverter means to allow said diverter means to move to said extended position when said sleeve is in said second position.

3. The downhole wash tool of claim 2 including:

a means for biasing said sleeve towards said first position.

4. The downhole wash tool of claim 3 wherein said biasing means comprises a spring.

5. The downhole wash tool of claim 1 wherein said means for moving said retainer is hydraulically-actuated.

6. The downhole wash tool of claim 1 wherein said means for moving said retainer means comprises:

a piston on said sleeve responsive to fluid pressure.

7. A downhole wash tool adapted to be lowered into a well tubular, said tool comprising:

a housing having a longitudinal bore therethrough adapted to be fluidly connected at a first end to a workstring;

a nozzle at a second end of said housing and in fluid communication with said bore;

a collet on said housing, said collet comprising a plurality of diverters which are movable between a retracted position against said housing and an extended position wherein said diverters will contact said well tubular when said tool is in an operable position within said tubular;

a retainer for engaging and normally retaining said diverters in said retracted position against said housing when in a first position and to disengage said diverters to allow said diverters to move to said extended position when moved to a second position; and means for moving said retainer towards said second position.

8. The wash tool of claim 7 wherein said retainer comprises:

a sleeve slidably mounted on said housing and being moveable thereon between a first position and a second position, said sleeve being adapted to engage and hold said diverters in said retracted position against said housing when said sleeve is in said first position and to disengage said diverters to allow said diverters to move to said extended position when said sleeve is in said second position.

9. The downhole wash tool of claim 8 including:

a means for biasing said sleeve towards said first position.

10. The downhole wash tool of claim 9 wherein said biasing means comprises a spring.

11. The downhole wash tool of claim 10 wherein said means for moving said retainer towards said second position comprises:

a piston on said sleeve; and means for fluidly communicating said longitudinal bore in said housing with said piston on said sleeve.

12. The downhole wash tool of claim 7 wherein said diverters are comprised of steel.

13. The downhole wash tool of claim 8 wherein the inner surface of said sleeve is tapered to facilitate engagement of said diverters.

* * * * *